US005429554A

United States Patent [19]

Burkholder

[11] Patent Number: 5,429,554

[45] Date of Patent: Jul. 4, 1995

[54] AUTOMATIC PINSETTER TRIGGER AND CONTROL SYSTEM

[75] Inventor: Roy A. Burkholder, Whitehall, Mich.

[73] Assignee: Brunswick Bowling & Billiards Corporation, Lake Forest, Ill.

[21] Appl. No.: 80,294

[22] Filed: Jun. 21, 1993

[51] Int. Cl.[6] ..... A63D 5/00

[52] U.S. Cl. ..... 473/73; 473/57; 473/65; 473/66; 473/81

[58] Field of Search ..... 473/57, 58, 65, 73, 473/66, 81, 87, 101, 64, 67, 93; 340/323 R

[56] References Cited

U.S. PATENT DOCUMENTS

| | | | |
|---|---|---|---|
| 2,840,204 | 6/1958 | Mathamel et al. | 473/66 |
| 2,949,300 | 8/1960 | Huck et al. | 473/57 |
| 3,189,348 | 6/1965 | Keahey | 473/66 |
| 3,195,892 | 7/1965 | Hildebrant et al. | 473/65 |
| 3,219,345 | 11/1965 | Rogers | 473/57 |
| 3,252,705 | 5/1966 | Cornberg | 473/58 |
| 4,275,884 | 6/1981 | Smith | 473/66 |
| 4,350,337 | 9/1982 | Knauer et al. | 473/66 |
| 4,592,548 | 6/1986 | Oldson | 473/66 |
| 4,724,506 | 2/1988 | Isawa | 473/73 X |

FOREIGN PATENT DOCUMENTS

| | | | |
|---|---|---|---|
| 3039313 | 5/1982 | Germany | 437/58 |

*Primary Examiner*—V. Millin
*Assistant Examiner*—Kerry Owens
*Attorney, Agent, or Firm*—Wood, Phillips, VanSanten, Clark & Mortimer

[57] ABSTRACT

An automatic pin setter includes a pinsetting deck structure movable toward and away from a pin supporting surface on a bowling lane for controlling setting of bowling pins on the lane supporting surface. A rake sweeps pins from the lanes. A rake up switch senses if the rake is in a raised position. A drive system is operatively coupled to the deck structure and rake and includes a cycle solenoid, the drive system for controlling an automatic pin setter cycle in response to energization of the solenoid. The pinsetter cycle controls movement of the deck structure and the rake to selectively remove or set pins on the lane. A pit cushion is positioned at a rear end of the lane and is linked to the rake to lower the rake from the raised position when a thrown ball strikes the pit cushion. A control comprises a ball sensor mounted on the lane before the pit cushion for sensing presence of a ball on the lane and developing an electrical trigger signal in response thereto. A ball selector selects if a thrown ball is a first or second ball thrown in a bowling frame. A pin setter trigger control is electrically connected to the rake up switch, the ball sensor, the ball selector and the cycle solenoid. The trigger control includes a trigger mode for automatically energizing the cycle solenoid to initiate a pinsetter cycle after either the rake up switch senses that the rake is not in the raised position or the ball sensor has sensed presence of a ball on the lane. A time delay delays operation of the trigger mode if the ball is the first ball thrown.

27 Claims, 9 Drawing Sheets

AUTOMATIC PINSETTER TRIGGER AND CONTROL SYSTEM

FIELD OF THE INVENTION

The present invention relates generally to automatic pinsetters used in bowling centers, and more particularly to an improved trigger and control system for such a pinsetter.

BACKGROUND OF THE INVENTION

Bowling centers have evolved from systems which required the manual setting of ten pins on the lane and manual scoring during game play to systems which use automatic pinsetting devices, such as described in Huck, et al. U.S. Pat. No. 2,949,300. The pinsetting device described in the Huck et al. patent while being an automatic pinsetter was primarily mechanically controlled.

The Huck et at. pin setter included a pinsetting deck structure movable toward and away from a pin supporting surface on a bowling lane for controlling setting of bowling pins on the lane's supporting surface. A drive system was operatively coupled to the deck structure and used momentum of a bowling ball striking a pit cushion to directly engage a gearbox clutch. The drive system controlled an automatic pinsetter cycle in response to engagement of the gearbox clutch, the pinsetter cycle controlling movement of the deck and a rake to selectively remove or set pins on the lane. The clutch could also be engaged by depressing a reset button to energize a cycle solenoid.

The above pinsetter in a modified form included a rake trigger switch to sense if the rake was in a raised position. The pit cushion positioned at a rear end of the lane was linked to the rake to lower the rake from the raised position when a thrown ball struck the pit cushion. The drive system controlled an automatic pin setter cycle in response to energization of the solenoid, the pin setter cycle controlling movement of the deck and the rake to selectively remove or set pins on the lane.

Such a mechanical pinsetter required forward momentum of the bowling ball to mechanically trigger the system. Normally, this is not a concern. More recently, to increase interest in the game of bowling in young children games such as bumper bowling have been initiated. Also, there has been an increase in older aged bowlers. Consequently, the balls may be thrown at such a low velocity or lighter weight balls may be used so that the mechanical triggering might not occur. Further, worn or misadjusted mechanical parts may not effectively trigger the pinsetter. Any of these conditions would require the bowler to press the reset button.

Alternative pinsetters and pin setter control systems utilize electronic triggers which either signal the reset button, signal a rake drop solenoid which trips the rake up limit switch, directly signal the cycle solenoid or signal an existing time delay module. Such a time delay module is used to provide a time delay when a first ball is thrown to allow wobbling pins to fall. However, such systems are often add on to an original pin setter which alter the original systems ABC approved cycled time delays or scoring systems.

With any automatic pin setter safety must also be a concern. For example, it is desirable to prevent a pin setter cycle operation if an obstruction exists. This might happen, for example, during servicing of the pinsetter or if a child or parent follows a slow ball toward the pinsetter and possibly triggers the pinsetter.

While adequate safety can be provided by turning the main circuit breaker off, additional levels of protection are desirable in the event that the circuit breaker remains on.

The present invention is intended to solve one or more of the problems discussed above in a novel and simple manner.

SUMMARY OF THE INVENTION

In accordance with the invention there is provided an automatic pinsetter trigger control system which begins a pinsetting cycle automatically in response to either an electronic or mechanical triggering of the pinsetter.

There is also disclosed an automatic pinsetter including a safety shut-off to prevent operation of a pin setter cycle if the rake is obstructed from operation.

Broadly, there is disclosed herein an improved pinsetter control for an automatic pinsetter including a pinsetting deck structure movable toward and away from a pin supporting surface on a bowling lane for controlling setting of bowling pins on the lane supporting surface. A rake sweeps pins from the lanes. A rake up switch senses if the rake is in a raised position. A drive system is operatively coupled to the deck structure and rake and includes a cycle solenoid, the drive system for controlling an automatic pin setter cycle in response to energization of the solenoid. The pin setter cycle controls movement of the deck structure and the rake to selectively remove or set pins on the lane. A pit cushion is positioned at a rear end of the lane and is linked to the rake to lower the rake from the raised position when a thrown ball strikes the pit cushion. The control comprises a ball sensor mounted on the lane before the pit cushion for sensing presence of a ball on the lane and developing an electrical trigger signal in response thereto. A ball selector means selects if a thrown ball is a first or second ball thrown in a bowling frame. A pinsetter trigger control is electrically connected to the rake up switch, the ball sensor, the ball selector means and the cycle solenoid. The trigger control includes trigger means for automatically energizing the cycle solenoid to initiate a pin setter cycle after either the rake up switch senses that the rake is not in the raised position or the ball sensor has sensed presence of a ball on the lane. Time delay means delay operation of the trigger means if the ball is the first ball thrown.

It is a feature of the invention to further provide a reset selector electrically connected to the trigger control, the trigger control further including reset means for automatically energizing the cycle solenoid in response to actuation of the reset selector.

It is a further feature of the invention to provide a rake down switch electrically connected to the trigger control for sensing if the rake is in a lower sweep position, the trigger control further comprising safety means for preventing energization of the cycle solenoid if the rake is not in either the raised position or the sweep position.

It is another feature of the invention that the safety means also include means for disabling the drive system if the rake is not in either the raised position or the sweep position.

It is an additional feature that the time duration is a fixed time duration.

It is still a further feature of the invention to provide a rake down switch electrically connected to the trigger control for sensing if the rake is in a lower sweep position, the trigger control further including safety means for disabling the drive system if the rake is not in the sweep position immediately after energization of the cycle solenoid.

It is yet another feature of the invention that the trigger control includes means associated with the trigger means for waiting until a pinsetter cycle is complete as determined by the rake returning to the raised position prior to actuating a further pin setter cycle.

It is yet still another feature of the invention to provide a reset selector electrically connected to the trigger control, the trigger control further including reset means for automatically energizing the cycle solenoid to initiate a pinsetter cycle in response to actuation of the reset selector.

It is still another feature of the invention that the trigger control further comprises means associated with the trigger means for waiting a select time duration after the reset selector is actuated during a pin setter cycle to actuate a further pinsetter cycle.

It is another feature of the invention to provide means for connecting a scorer take data relay to the trigger control to activate the take data relay after a fixed time delay only if the rake is still up on the first ball or if the reset selector is actuated.

It is also a feature of the invention to relate triggering to removal of a ball from blocking a sensor beam, regardless of ball speed. If the sensor beam is blocked indefinitely, then the system waits to trigger, providing a safety feature.

It is another feature of this invention to provide a signal output for ball speed based on the time duration that the ball sensor beam was blocked.

It is a feature of this invention that the normal rake drop trigger signal and the reset signal will continue to trigger the cycle solenoid in the absence of a ball sensor signal. Thus the system can be configured without a ball sensor with full safety shut-off features.

It is another feature of the invention that the ball sensor is located behind the rake sweep, directly in front of the head pin, without requiring extra mercury switches to prevent the rake from causing multiple triggering of the system as it breaks the beam of the ball sensor during its sweeping action.

It is another feature of the invention that the trigger control can be used on existing pinsetters whether or not the existing pinsetter includes a time delay module.

Further features and advantages of the invention will be readily apparent from the specification and from the drawings.

DETAILED DESCRIPTION OF THE INVENTION

Figure 1:
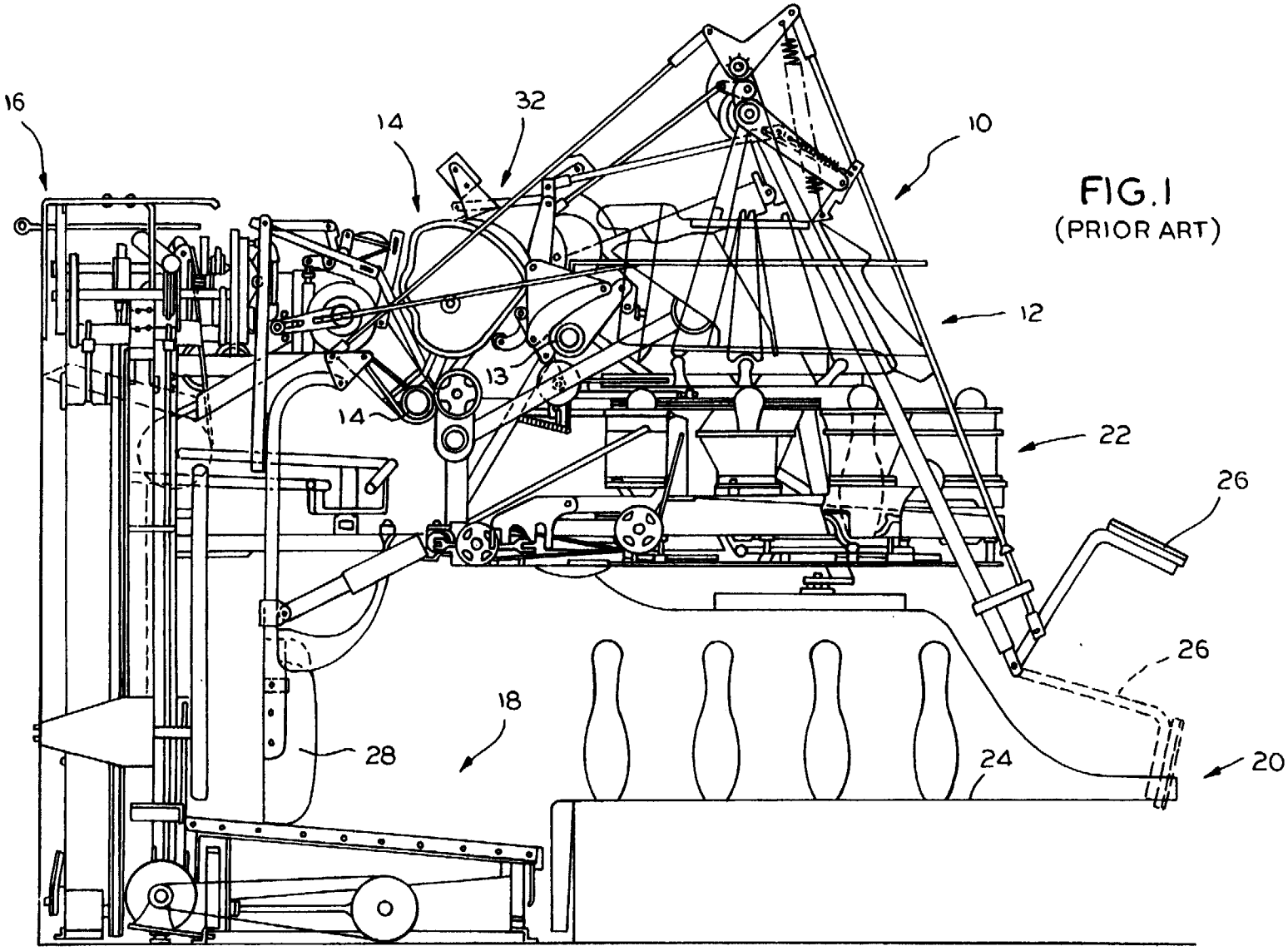
FIG. 1 (PRIOR ART)
FIG. 1 is side elevation view of a prior art automatic pinsetter.

Referring first to FIG. 1, a prior art automatic pinsetter 10 is illustrated. The illustrated automatic pinsetter 10 comprises a model A Automatic Pinsetter such as made by Brunswick Corporation. The general mechanical structure for such a pin setter was described initially in Huck et al. U.S. Pat. No. 2,949,300, the specification of which is hereby incorporated by reference herein and also Rogers U.S. Pat. No. 3,219,345, the specification of which is also hereby incorporated by reference herein.

For a derailed description of the pinsetter 10, reference may be had to either such patent. The present invention relates to improvements to such a pinsetter. Reference will made to the particular structure of the pinsetter 10 relevant to the improvement.

The pinsetter 10 includes a turret structure 12 and a conveyor structure 14 arranged to deliver pins one at a time to the turret structure 12. The conveyor structure 14 is adapted to receive pins from a pin gathering mechanism 16 for collecting pins in a pit 18 at the end of a bowling lane 20, elevating the pins to the level of the receiving end of the conveyor structure 14 and depositing the pins on the conveyor structure 14 for travel serially with the butts of the pins leading. The turret structure 12 is adapted to deliver as many as full complement of ten pins to a pinsetting deck structure 22. The deck structure 22 is movable toward and away from a pin supporting surface 24 on the lane 20 for controlling setting of bowling pin on the lane supporting surface 24. The deck structure 22 also lifts standing pins after a first ball is rolled in order to permit removal of deadwood, and resetting such pins in playing position for the second ball. It is not intended that a complete automatic pinsetter be described and illustrated herein, but rather that reference should be made to such known pin setters as described in the above described patents incorporated by reference herein.

A pit cushion 28 is suspended across the pit 18 to stop the forward momentum of a ball after the ball passes the playing area of the lane 20. The pit cushion 28 is mechanically linked to a drive system 32 including a gearbox clutch to initiate a pinsetter cycle. The pinsetter cycle controls movement of the deck structure 22 and a rake 26 to selectively remove or set pins on the lane. The rake 26 sweeps the deadwood from the lane 20 to the pit 18. Normally, the rake 26 is in a raised position as illustrated in solid line in FIG. 1. After a bowling ball is thrown the rake 26 is mechanically moved to a lower sweep position, as illustrated in phantom in FIG. 1.

Figure 1A:
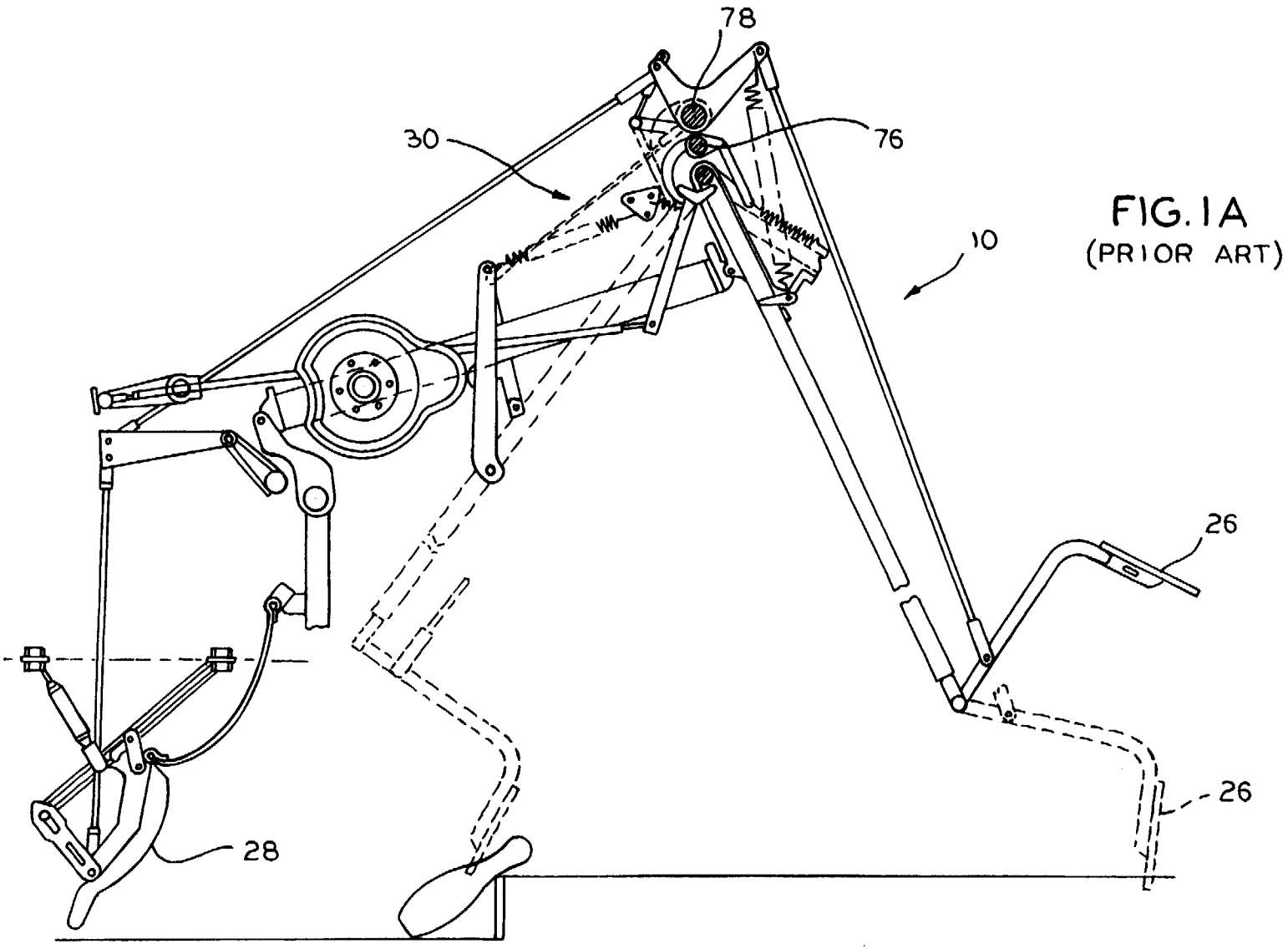
FIG. 1A (PRIOR ART)
FIG. 1A is side elevation view of a portion of a modified prior art automatic pinsetter.

A modified form of the pinsetter 10 is shown in FIG. 1A. Such a modified pinsetter comprises a model A-2 pinsetter such as made by Brunswick Corporation. Particularly, a linkage mechanism 30 mechanically links the pit cushion 28 to the rake 6 to lower the rake 26 and trigger the machine at the start of a cycle. The drive system 32 is operatively coupled to the deck structure 22 and the rake 26 and includes a cycle solenoid, discussed below, energized by a rake trigger switch. The drive system 32 controls an automatic pin setter cycle in response to energization of the solenoid. The pin setter cycle controls movement of the deck structure 22 and the rake 26 to selectively remove or set pins on the lane.

Figure 2:
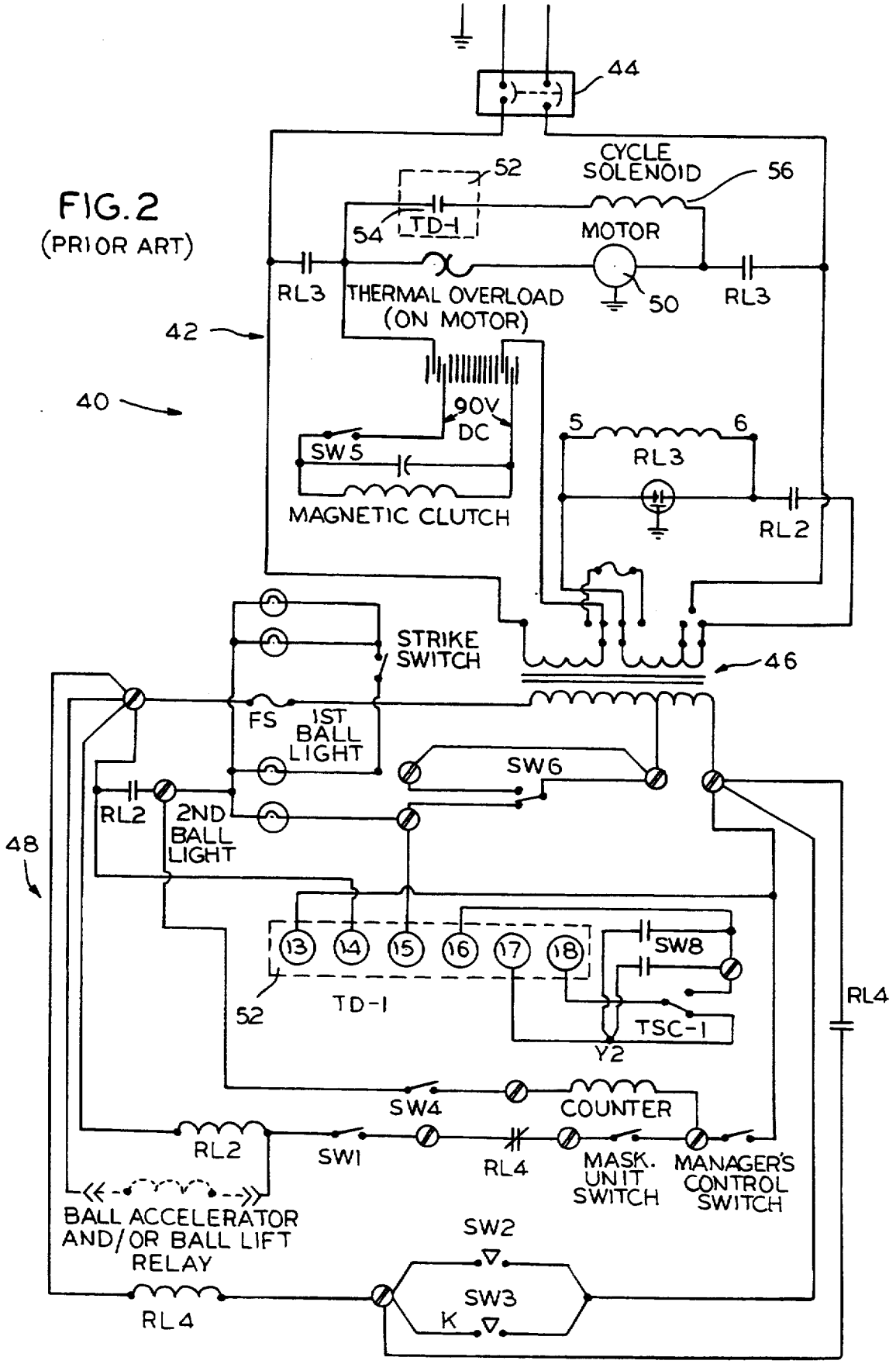
FIG. 2 (PRIOR ART)
FIG. 2 is an electrical schematic drawing for a prior art automatic pinsetter such as shown in FIG. 1.

Referring to FIG. 2, a schematic diagram of an electrical control 40 which has been used with the A-2 pinsetter 10 of FIG. 1A is illustrated. The control 40 includes a primary or high voltage circuit 42 connected via a circuit breaker 44 to a supply. A transformer 46 connects the primary circuit 42 to a secondary or low voltage control circuit 48.

The control circuit 48 includes series connected switches for controlling a motor start relay RL2. When the motor start relay RL2 is energized the coil of a motor contactor RL3 is energized placing the pinsetter main drive motor 50 and its thermal overload across the input power line. The pinsetter 10 is thus energized. When the rake 26 is mechanically triggered after delivery of the first ball, a rake trigger switch TSC-1 is closed. The trigger switch TSC-1 is connected to a time delay module 52. The time delay module 52 includes an internal, electric time delay circuit. When the time lapse is completed, a set of contacts 54 within the module 52 closes to place the cycle solenoid 56 across the power line. The cycle solenoid 56 triggers the gear box clutch of the drive system 32 to start a pinsetter cycle. As the rake 26 lowers after delivery of the second ball, the trigger switch TSC-1 is closed as above. However, a switch SW6 which is connected to the time delay module 52 is in position to indicate that a second ball is being thrown. The time delay circuit in the time delay module 52 is thus bypassed and the cycle solenoid 56 is energized immediately to engage the gearbox clutch. There is no need for a time delay on the second ball, since the deck structure 22 does not lower to detect after second ball. The time lapse from ball impact until the rake 26 sweeps is sufficient to permit wobbling pins to fall. A reset switch SW8 is also connected to the time delay module 52 to initiate pinsetter cycle in response to a user depressing a reset button as is well known.

In accordance with the invention, the control 40 of FIG. 2 is modified as by replacing the time delay module 52 with a programmed micro-processor control unit, adding an electronic ball detector trigger and adding a rake down switch, as discussed below. Also, the control unit could be used on the prior model A pinsetter which did not include the time delay module 52, as will be apparent.

Figure 3:
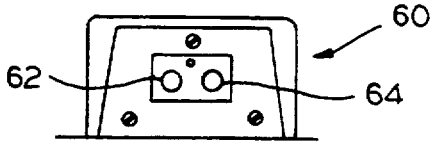
FIG. 3 is an elevation view illustrating a ball detector to be added to the pinsetter of FIG. 1 in accordance with the invention.
Figure 4:
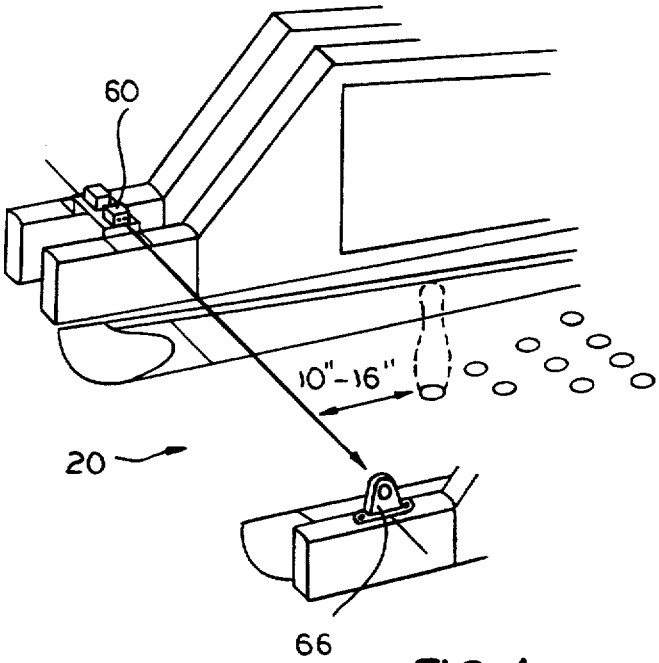
FIG. 4 is a perspective view illustrating mounting of the ball detector of FIG. 3 on a bowling lane.

Referring to FIG. 3, a ball sensor or detector 60 is illustrated. The ball detector 60 is an infrared ball detector mounted ahead of the kick back, below the drop sweep, as illustrated in FIG. 4. The detector 60 includes a transmitter 62 and a receiver 64. The detector 60 is mounted level across the lane 20 so that the infrared detector beam is ten inches to sixteen inches in front of the headpin as shown. A reflector 66 is mounted opposite the detector 60. The beam from the transmitter 62 is reflected by the reflector 66 and received by the receiver 64. The detector 60 develops an electrical signal indicating when a return beam is received, i.e. when no ball is present, and when the beam is broken, i.e. a ball is present.

Figure 5:
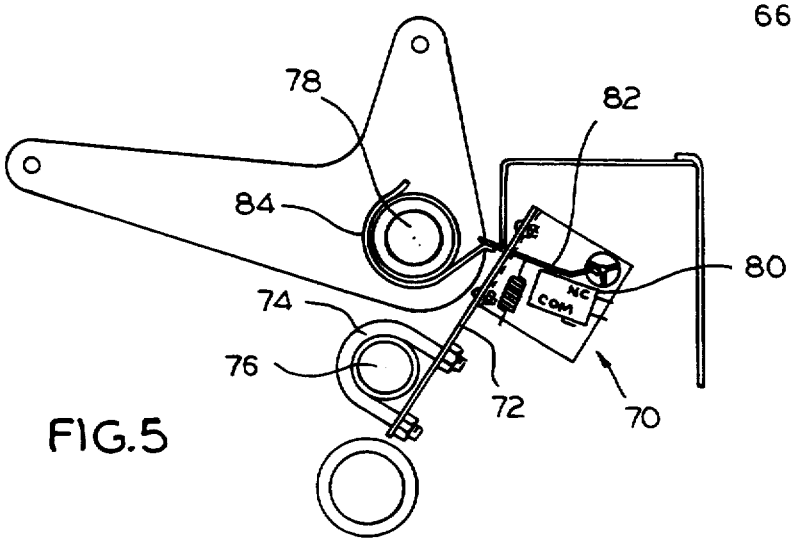
FIG. 5 is a partial elevation view illustrating a rake down limit switch to be added to the pinsetter of FIG. 1 according to the invention.

Referring to FIG. 5, a rake down limit switch assembly 70 is illustrated. The assembly 70 includes a bracket 72 mounted via a u-bolt 74 to the center cross brace 76 below the rake lift shaft 78, see also FIG. 1A. The bracket mounts a limit switch 80 actuated by a spring biased actuator leveler 82. A triggering clip 84 is mounted on the rake lift shaft 78. With the rake 26 in the lower sweep position as illustrated in phantom in FIG. 1, the clip 84 is positioned so there is a 1/16 inch gap with the rake down.

Figure 6:
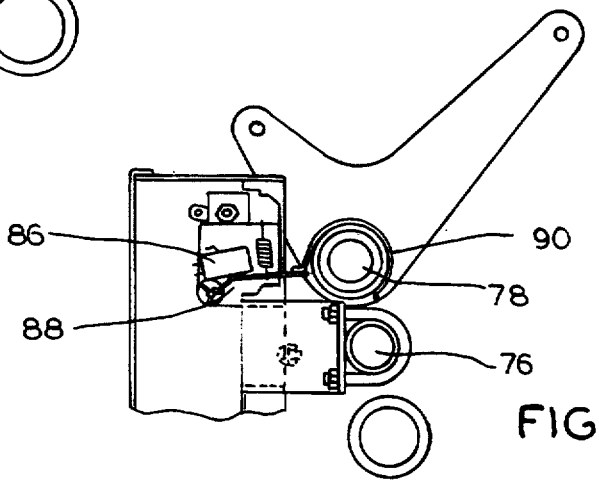
FIG. 6 is a partial elevation view illustrating a rake up limit switch for the pinsetter of FIG. 1.

Referring to FIG. 6, a rake up limit switch 86 is illustrated also mounted to the cross brace 76. The rake up limit switch 86 is the rake trigger switch TSC-1, see FIG. 2, on a Model A-2 pinsetter or is a new switch for a Model A pinsetter. The rake up limit switch 86 is actuated by a spring biased actuator lever 88 and a triggering clip 90 also mounted to the rake lift shaft 78. The triggering clip 90 is positioned so that there is a small gap so that the limit switch 86 is not actuated when the rake 26 is in the raised position.

Figure 7:
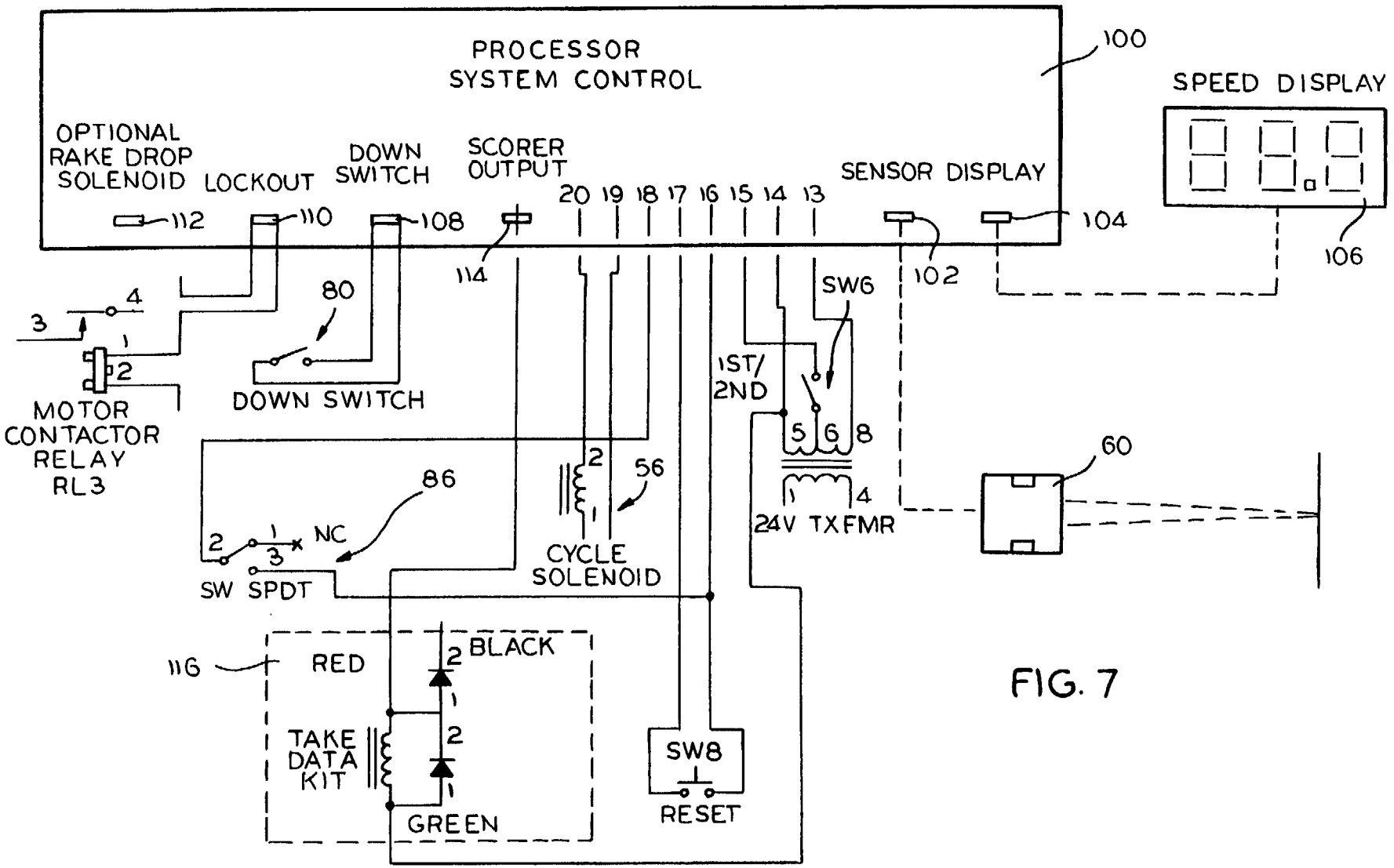
FIG. 7 is a generalized block diagram/schematic diagram illustrating a modification to the circuit of FIG. 2 according to the invention.

With reference to FIG. 7, a schematic diagram illustrate connections to a processor system control 100 according to the invention which replaces the time delay module 52 of FIG. 2. This is accomplished by physically removing the time delay module 52 and replacing it with a control board for the processor system control 100. The processor system control 100 includes an on-board micro-processor and related circuits of a conventional nature for controlling the triggering and control functions, as described below. Particularly, it accepts inputs from the ball detector 60 and the rake position switches 80 and 86 and adjusts the time delays, cycle and scoring functions to provide an ABC approved system. It also offers enhanced features to trigger an optional rake drop solenoid and to automatically switch back to mechanical triggering in the absence of an electronic ball detect signal. Once the pinsetter cycle is started, a reset button SW8 is effectively locked out for a select time duration or until the cycle ends to prevent "banana stops". Another important feature is the implementation of a safety shutoff features which shuts off the pinsetter motor 50 if the rake drop is blocked.

Once the processor system control 100 physically replaces the time delay 52 module, the original connections are made to the same terminals as labeled in FIG. 2. Particularly, the processor system control is connected via terminals labelled 13, 14 and 15 to the transformer 46 and the first second ball switch SW6 and via terminals 16 and 17 to the reset switch SW8. The terminal 18 is connected to the rake up switch 86. The terminals 19 and 20 are connected to the cycle solenoid 56. Additionally, a terminal 100 is are provided for connecting to the ball detector 60 and a terminal 104 for connecting to a multiple digit speed display 106. An additional input terminal 108 is connected to the rake down switch 80 and a lockout output terminal 110 is connected in series with the motor contactor relay RL3. An optional rake drop solenoid output terminal 112 is shown unconnected. A scorer output terminal 114 is shown connected to a take data kit 116 of a separate automatic scoring system not shown.

Figure 8:
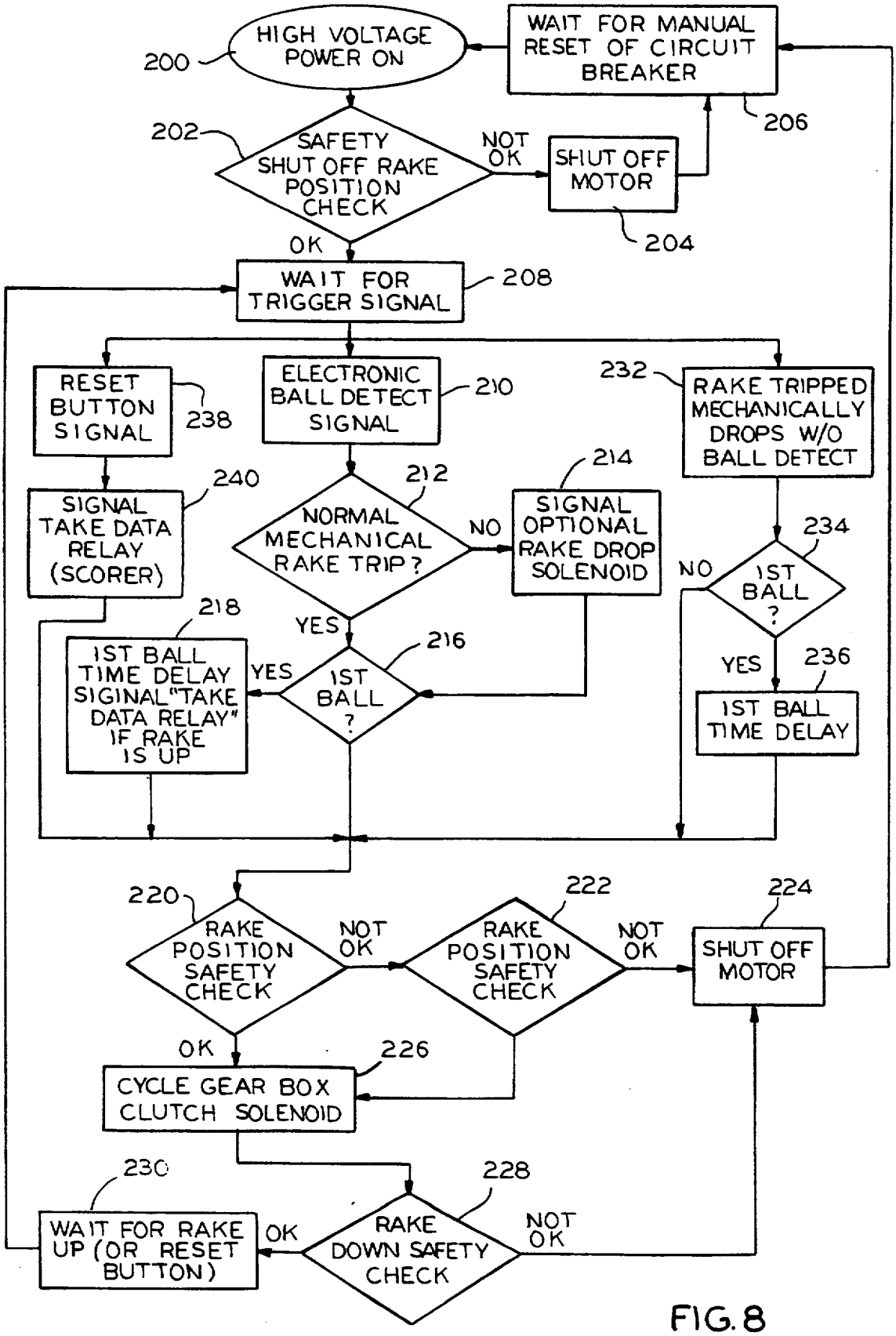
FIG. 8 is a flow diagram illustrating an overview of a control program implemented by a processor system control of FIG. 7.

With reference to FIG. 8 a flow diagram illustrates an overview of a control program implemented by the processor system control of 100 of FIG. 7. Control begins at block 200 when high voltage power is first turned on. Initially, a safety shutoff rake position check is made at a decision block 202. This check verifies that the rake 26 is in either the raised position or the lower sweep position, as determined by the switches 80 and 86. If not, then the motor 50 is shut off by opening the lockout output 110, see FIG. 7, at a block 204. The control then waits at a block 206 for manual reset of the circuit breaker 44.

If the safety shut-off rake position check passes, as determined at the decision block 202, then a block 208 waits for a trigger signal. The trigger signal can come from any one of three sources. The primary source is the ball detect signal from the detector 60. The secondary source is mechanical triggering by the rake up switch 86. The third alternative is a user depressing the reset button SW8. If an electronic ball detect signal is received at block 210, then a decision block 212 determines if this signal is followed by a normal mechanical rake trip, as determined by the rake up switch 86. If not, then an optional rake drop solenoid is energized at a block 214. In either case, the control then advances to a block 216 which determines if the ball thrown is a first ball or second ball as determined by the position of the switch SW6. If a first ball, then a first ball time delay is implemented at a block 218 and a take data ready relay output is energized if the rake is up as by energizing the output 114, see FIG. 7. Particularly, this is used to coordinate the reading of the standing pins by the automatic scorer so that the pins are read before the rake 26 drops if it is still up. Thereafter, or if the ball thrown is a second ball, then control advances to a decision block 220 which performs a further rake position safety check, as above. If not, then the check is repeated several times at a block 222. If the check still does not pass, then the motor 50 is shut off by opening the lockout output 110, see FIG. 7 at a block 224 and control returns to the block 206. If the safety check passes from either the block 220 or the block 222 then the cycle solenoid is energized at a block 226. After a short delay a rake down safety check is performed at a block 228 to verify that a rake drop has occurred. If not then control advances to the block 224 to shut off the motor 50 due to failure of the rake 26 to drop to the lower sweep position indicating some obstruction. If the rake down safety check passes, then control waits at a block 230 for the rake 26 to return to the raised position as determined by the rake up switch 86, or the reset button SW8 is pressed after a select time duration, prior to returning to the block 208 for the next pinsetter cycle.

From the block 208 if due to failure of the ball detect signal the rake is mechanically tripped as determined at a block 232, then a normal mechanical pinsetter cycle is actuated as by advancing to a decision block 234 which determines if the ball thrown is a first ball or second ball. If a first ball, then the time delay is implemented at a block 236. Thereafter, or if the ball is not the first ball, then control advances to the block 220 discussed above to initiate the pinsetter cycle.

From the block 208 if a reset button signal is received at a block 238 then a take data relay is energized through the output 114 to the scorer at a block 240 and control then proceeds to the decision block 220.

Thus, in accordance with the invention, the control 100 responds to any of the electronic ball detector 60, the rake up switch 86 or the reset switch SW8 to begin a pinsetter cycle. A safety shut-off feature prevents operation of the pin setter cycle in the event that the rake 26 is obstructed so that it stops at an intermediate position between the raised position and lower sweep position.

With a Model A pin setter the operation is similar, except that mechanical triggering occurs as a result of the pit cushion 28 directly engaging the gear box clutch.

With reference to FIGS. 9A–9F, a series of flow diagrams illustrates in greater detail the program of FIG. 8.

Control begins at a node 300 when the circuit breaker 44 is first turned on. Various parameters are initialized at a block 302 followed by a delay at a block 304. A decision block 306 then determines if the rake 26 is in the up position. If not, then a decision block 308 determines if the rake 26 is in the down or lower sweep position. If not, then control advances to a lockout routine illustrated in FIG. 9D. Particularly, a lockout relay is turned on at a block 310 which opens the lockout output 110, see FIG. 7 to deenergize the motor contactor relay RL3 and thus the motor 50. Thereafter a COP timer is cleared at a block 3 12 and control loops back to the block 310 to effectively wait for a manual reset of the circuit breaker 44. The COP timer is a processor timer which resets the processor to perform an initialization routine if a timeout occurs.

Returning to FIG. 9A, if the rake 26 is either up or down, as determined at the decision block 306 or 308, respectively, then the velocity display 106 is blanked at a block 314 followed by a delay at a block 316. The decision block 318 determines if the reset button SW8 has been pressed. If not, then after a short delay at a block 320 a decision block 322 determines if the system has been mechanically tripped as by the rake 26 no longer being in the up position. If the rake 26 is in the up position then a decision block 324 determines if the reset switch SW8 is pressed. If so, then control loops back to the block 316 where the delay is followed by the decision block 318 to insure that the reset switch SW8 is still pressed. This protects against accidental reset due to voltage surges. If the reset switch SW8 is not pressed, then control advances via a node A to a block 326, see FIG. 9B where the COP timer is cleared. A decision block 328 then determines if the ball sensor or detector 60 is on, i.e., the sensor beam path is blocked indicating presence of a ball. If not, then control returns to the decision block 322. If so, then a block 330 determines the length of time that the sensor beam path is blocked. Triggering of the pinsetter operation begins when the beam is remade, i.e., the ball has passed. A decision block 332 determines if a fail flag is set. The fail flag is set if the input signal indicates that the beam was broken for less than ten milliseconds, most likely resulting from a voltage surge. If the fail flag is set then control returns to the decision block 322. If not, then the ball speed is displayed at a block 334. The bail speed is determined by knowing the length of time that the beam path is broken and the standard size of a bowling ball. The speed is displayed on the speed display 106, see FIG. 7. After a short delay at a block 336, a decision block 338 determines if the rake 26 is still in the up position. If so, then the optional rake drop relay is turned on at a block 340 and after a delay at a block 342 the rake drop relay is turned off at a block 344. From the block 344 or if the rake was not up as determined at the decision block 338, then control advances via a node B to a decision block 346 of FIG. 9C.

Thereafter, the detector signal is ignored. As a result, with the ball detector located behind the rake sweep, directly in front of the head pin, extra mercury switches are not required to prevent the rake from causing multiple triggering of the system as it breaks the beam of the ball detector during its sweeping action.

At the decision block 346 a determination is made if the ball thrown is a first ball or a second ball. If a first ball, then a 1.25 second display is implemented at a block 348 to provide sufficient delay for wobbling pins to fall. A decision block 350 then determines if the rake 26 is still up. If so, then a 1 second delay is implemented at a block 352 and the scorer output is pulsed via the output terminal 114, see FIG. 7, at a block 354. The one second delay is equivalent to the time duration of pin wobble allowed by the normal forty-four degree scoring cluster switch of the Model A-2 pinsetter. If the ball thrown was not the first ball, as determined at the decision block 346, then a one-half second delay is implemented at a block 350. From either block 350 or 352, control proceeds to a safety shut-off routine beginning at a block 356.

The safety shut-off routine begins at the block 356 with the determination of whether or not the rake 26 is up. If not, then a decision block 358 determines if the rake is down. At this point in time the rake should either be in the raised position or the lower position. If the rake is at some other position, then it is most likely due to some form of undesirable obstruction which should result in system shutdown. If the rake 26 is not down, then a half second delay is implemented at a block 360 and the control proceeds to another decision block 362 which determines if the rake 26 is yet down. If not then a 1 second delay is implemented at a block 364 and then an additional block 366 determines if the rake 26 is yet down. If not, then a further 2 second delay is implemented at a block 368. Control then advances to a decision block 370 which again determines if the rake 26 is yet down. If not, then the lockout relay is turned on at the block 310.

If the rake 26 is down as determined at the decision block 370, or if the rake was up, as determined at decision block 356, then the cycle solenoid 56 is turned on at a block 372 and then after a short delay at a block 374 the cycle solenoid is turned off at a block 376. A two second delay is implemented at a block 378 to allow the pinsetter cycle to commence. A decision block 380 determines if the rake 26 is up. As is apparent, after the cycle solenoid 56 is energized the rake 26 should be down. If the rake 26 is up, then control returns to the decision block 322, see FIG. 9A to wait for a further trigger signal. If the rake is not up, then a decision block 382 determines if a reset bypass flag is set. If not, then a decision block 384 determines if the rake 26 is down. If not, then control proceeds to the block 310 to implement the lockout routine. If the reset bypass flag was set as determined at the decision block 382, or the rake 26 is down as determined at the decision block 384, then the reset bypass flag is reset at a block 386 and a counter is loaded with the value 255 at a block 388.

Figure 9A:
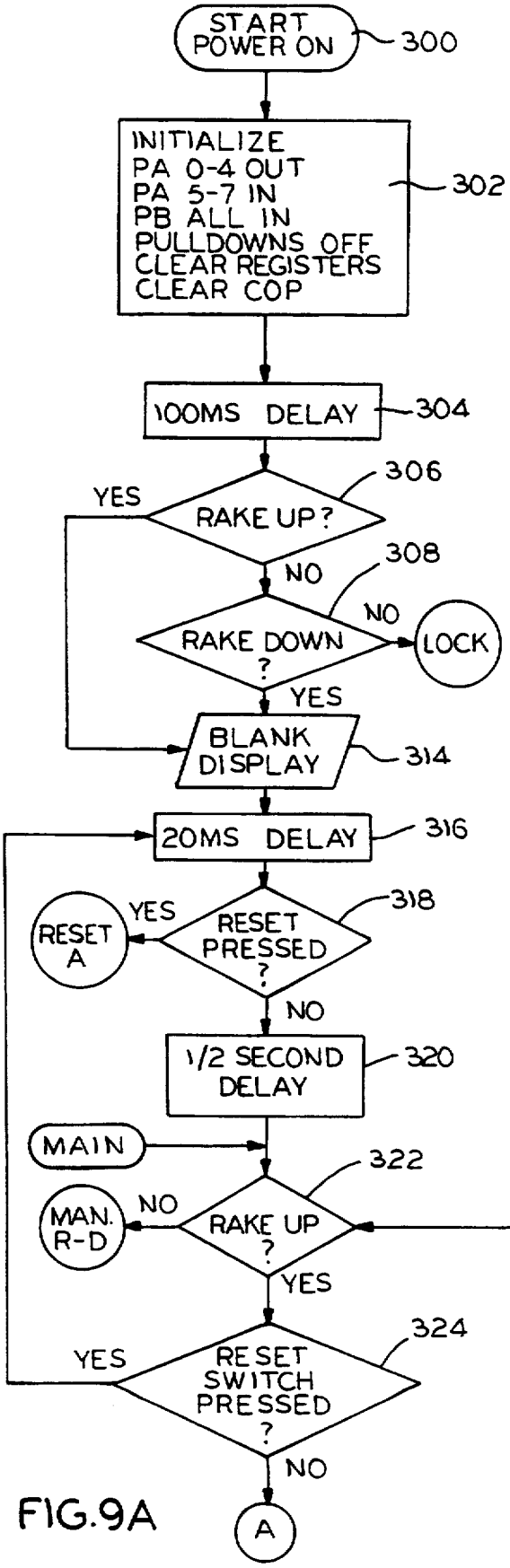
FIGS. 9A–9F comprise a series of flow charts illustrating operation of the program of the processor system control of FIG. 7 in greater detail.
Figure 9B:
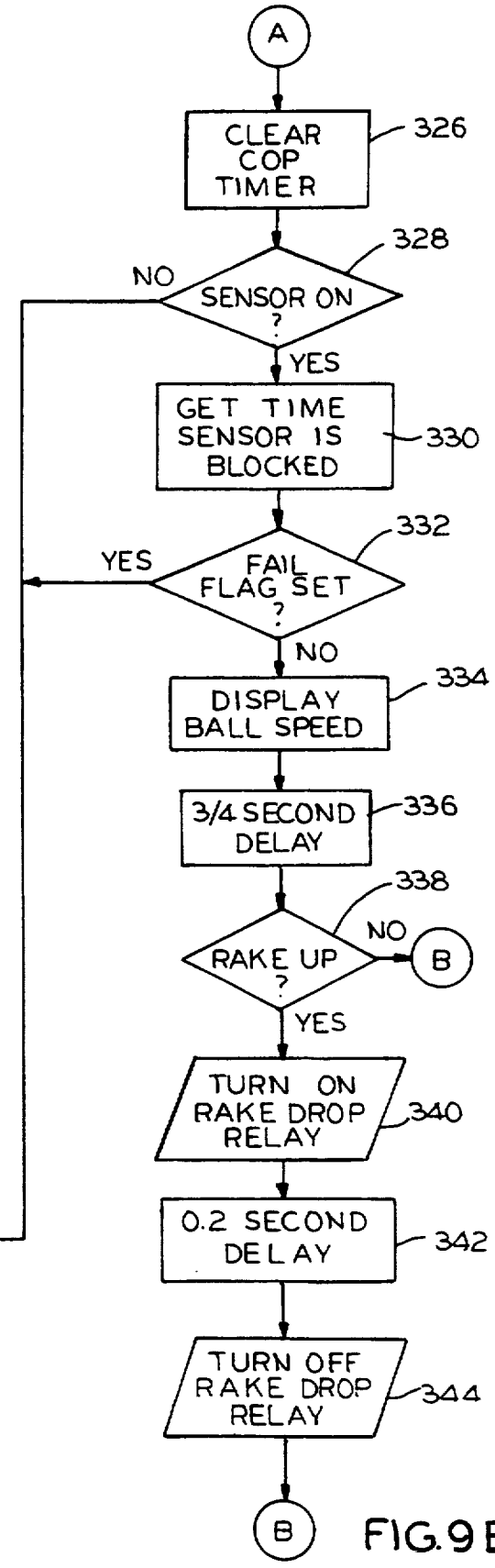
Figure 9C:
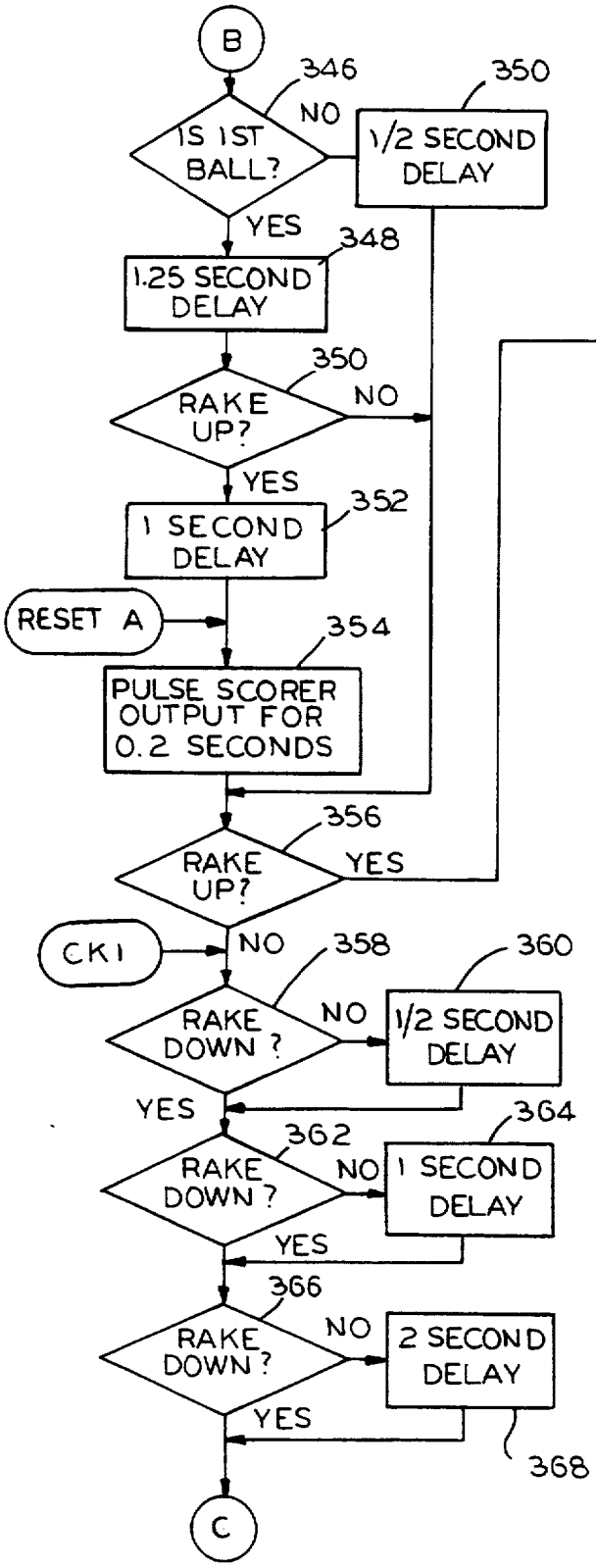
Figure 9D:
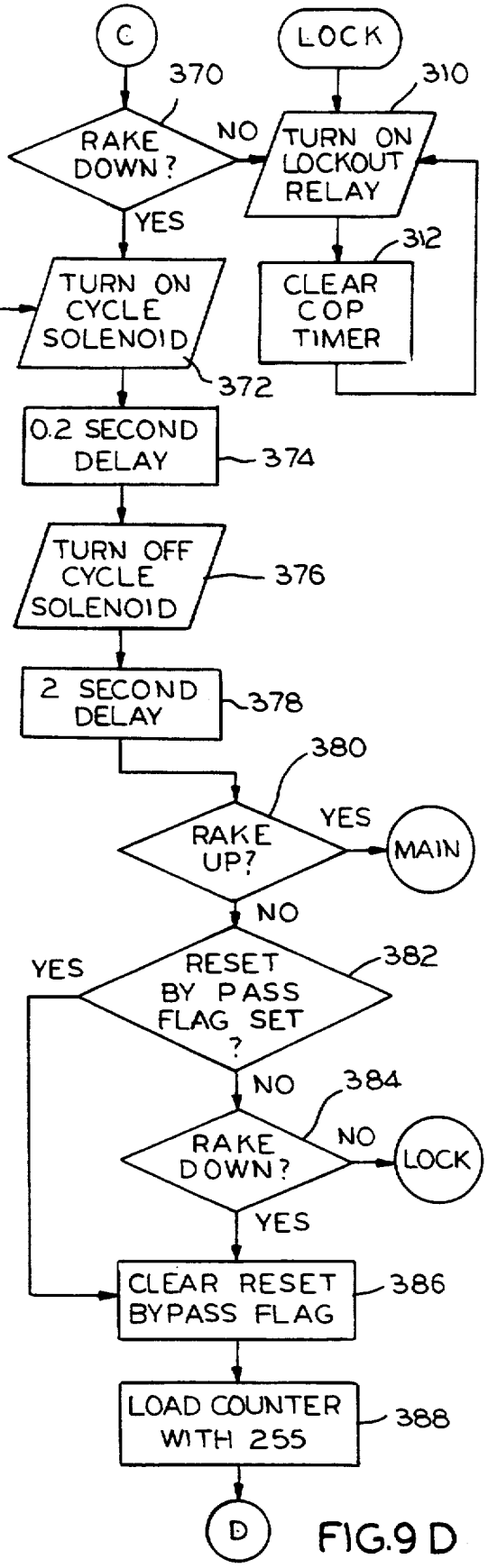
Figures 9E, 9F:
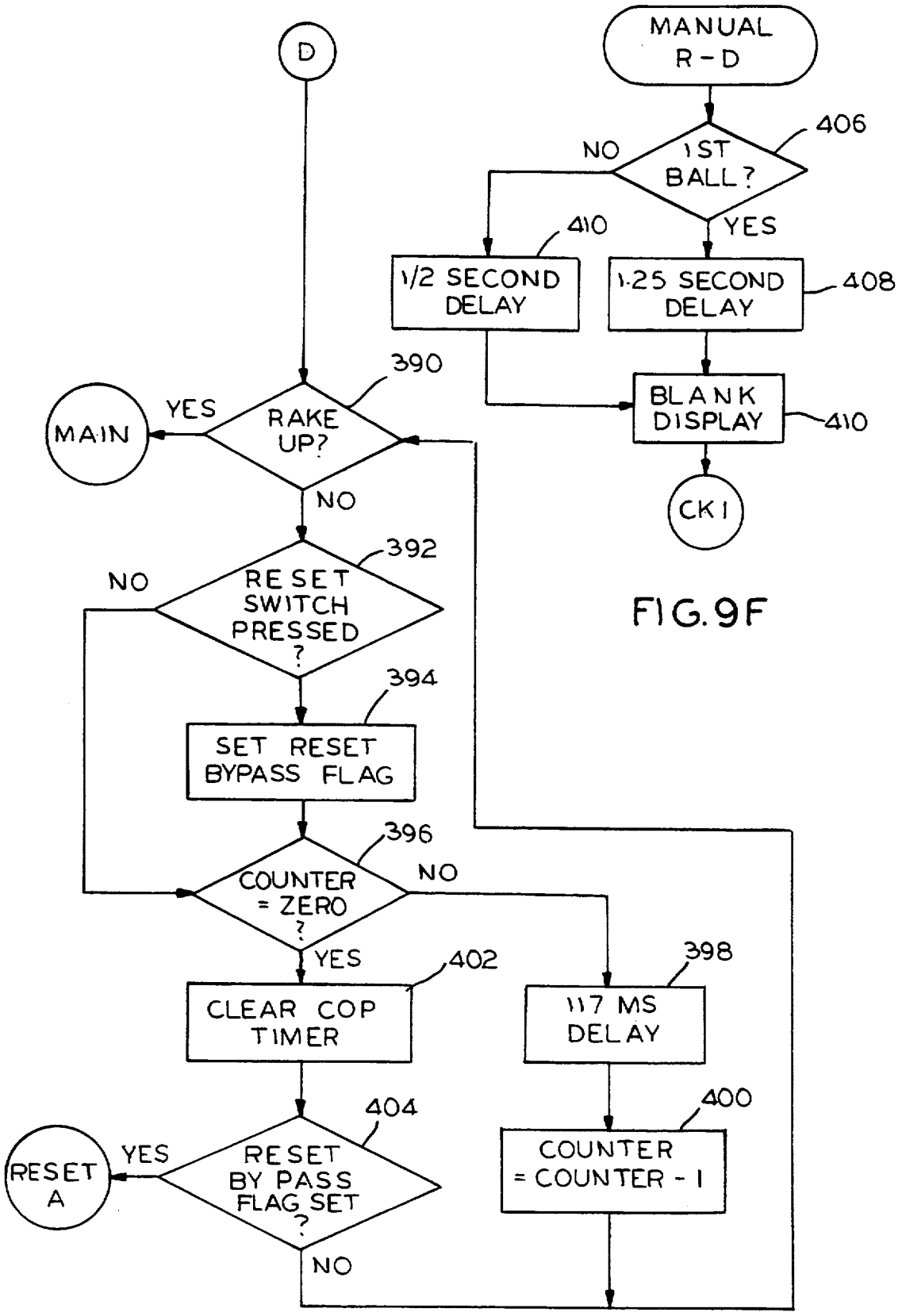

From the block 388 control proceeds via node D to a decision block 390 of FIG. 9E. This decision block 390 determines if the rake 26 has returned to the up position indicating the completion of the pinsetter cycle. If so, then control returns to the decision block 322, see FIG. 9A, to wait for the next trigger signal. This is the normal operation. Prior to completion of the pin setter cycle it is desirable to ignore the reset button SW8. Otherwise, banana stops could result with pins locked in scissors. However, if the pin setter is off, then at some point in time operation of the reset function is desirable. In accordance with the invention the reset button SW8 is locked out for either thirty seconds or until the rake returns to the up position.

If the rake 26 is not yet up, then a decision block 392 determines if the reset switch SW8 is pressed. If so, then the reset bypass flag is set at a block 394. Thereafter, or if the reset switch SW8 was not pressed, then a decision block 396 determines if the counter is equal to zero. Initially, the counter will not equal zero and control will proceed to a block 398 to implement a delay and the counter is then decremented by a one at a block 400 and control then loops back to the decision block 390. This loop provides the thirty second delay during which the reset switch SW8 is locked out to prevent to banana stops. Once the counter is equal to zero, as determined at the decision block 396, the COP timer is cleared at a block 402 and a decision block 404 determines if the reset bypass flag was set. If not, then control returns to decision block 390. If so, then control advances to the block 354, see FIG. 9C to implement the reset cycle.

The reset cycle is also initiated if the reset button SW8 was depressed as determined at the decision block 318 from which control proceeds to the block 354, as discussed above. If triggering occurs mechanically due to the rake trip, as determined at the decision block 322, see FIG. 9A, then a manual initialization is implemented by advancing to a decision block 406, see FIG. 9F, which determines if the ball thrown is a first ball or second ball. If first ball then a 1.25 second delay is implemented at a block 408. If not, then a one-half second delay is implemented at a block 410. From either, the speed display 106 is blanked at a block 410. The display is blanked when a mechanical tripping occurs due to the fact that the detector 60 is presumed to be not operable. Thereafter, control advances to the block 358 to implement the safety shut-off routine discussed above, prior to turning on the cycle solenoid 56.

The disclosed system provides various improvements over the prior mechanical pinsetters. A safety feature as provided using the rake down switch 80 as part of a safety shut-off circuit. The triggering of the pinsetter 10 is based on presence or absence of a ball, controlled by the micro-processor system. Thus, the pinsetter 10 cycles at the proper time for accurate pin fall and maximum pin wobble. Particularly, this is done because the triggering occurs when the beam is remade. The ball detector 60 is mounted inside of the rake 26 for accurate and efficient triggering to provide less ball calls and less pins in front of the rake 26. A ball speed display indicator 106 can be included. The control system ignores actuation of the reset button SW8 during a pinsetter cycle to eliminate troublesome banana stops. Finally, if the ball detector 60 is broken, the pinsetter 10 will continue to operate without a mechanic having to intervene and repair parts. The micro-processor control can thus emulate the conventional prior art time delay module.

The disclosed embodiment of the invention is illustrative of the broad inventive concepts comprehended by the invention.

I claim:

1. In an automatic pinsetter including a pin setting deck structure movable toward and away from a pin supporting surface on a bowling lane for controlling setting of bowling pins on the lane supporting surface, a rake for sweeping pins from the lane, a drive system operatively coupled to the deck structure and responsive to momentum of a bowling bail striking a pit cushion to engage a gearbox clutch and also responsive to energization of a cycle solenoid to engage the gearbox clutch, the drive system controlling an automatic pinsetter cycle in response to engagement of the gearbox clutch, the pinsetter cycle controlling movement of the deck and the rake to selectively remove or set pins on the lane, an improved pinsetter control comprising:

a bail sensor mounted proximate the lane before the pit cushion for sensing presence of a ball on the lane and developing an electrical trigger signal in response thereto;

a ball selector means for selecting if a thrown bail is a first or second bail thrown in a bowling frame; and a pinsetter trigger control electrically connected to said bail sensor, said bail selector means and said cycle solenoid, said trigger control including trigger means for automatically energizing said cycle solenoid to initiate a pinsetter cycle after the bail sensor has sensed presence of a bail on the lane and time delay means for delaying operation of the trigger means a select time duration if the bail is the first bail thrown, whereby said gearbox clutch is automatically engaged in response to either a bail striking the pit cushion or the bail sensor sensing presence of a thrown bail.

2. The improved pinsetter control of claim 1 further comprising a reset selector electrically connected to said trigger control, said trigger control further including reset means for automatically energizing said cycle solenoid in response to actuation of said reset selector.

3. The improved pinsetter control of claim 1 further comprising a rake down switch electrically connected to said trigger control for sensing if the rake is in a lower sweep position, the trigger control further comprising safety means for preventing energization of the cycle solenoid if the rake is not in either the raised position or the sweep position.

4. The improved pinsetter control of claim 3 wherein said safety means also includes means for disabling said drive system if the rake is not in either the raised position or the sweep position.

5. The improved pinsetter control of claim 1 wherein said select time duration is a fixed time duration.

6. The improved pinsetter control of claim 1 further comprising a rake down switch electrically connected to said trigger control for sensing if the rake is in a lower sweep position, the trigger control further comprising safety means for disabling said drive system if the rake is not in the sweep position immediately after energization of the cycle solenoid.

7. The improved pinsetter control of claim 1 wherein said trigger control further comprises means operatively associated with said trigger means for waiting until a pinsetter cycle is complete as determined by said rake returning to the raised position prior to actuating a further pin setter cycle.

8. The improved pin setter control of claim 7 further comprising a reset selector electrically connected to said trigger control, said trigger control further including reset means for automatically energizing said cycle solenoid to initiate a pinsetter cycle in response to actuation of said reset selector.

9. The improved pinsetter of claim 8 wherein said trigger control further comprises means operatively associated with said trigger means for waiting a select time duration after the reset selector is actuated during a pinsetter cycle to actuate a further pinsetter cycle.

10. The improved pinsetter control of claim 1 wherein said ball sensor comprises a transmitter developing a light beam and a receiver receiving the light beam except when the beam is obstructed by presence of a ball on the lane.

11. The improved pinsetter control of claim 1 wherein said ball sensor is positioned remote from the rake so that the rake sweep does not retrigger the system.

12. The improved pinsetter control of claim 1 further comprising means for connecting a scorer take data ready relay to the trigger control to activate the relay after a select time delay if the rake is in a raised position and if the ball is the first ball thrown.

13. The improved pinsetter control of claim 2 wherein said trigger control includes means for ignoring actuation of the reset selector during the pinsetter cycle.

14. The improved pinsetter control of claim 1 wherein the trigger control further comprises additional safety means for disabling said drive system if the rake is not in the sweep position immediately after energization of the cycle solenoid.

15. The improved pinsetter control of claim 1 wherein said trigger control further comprises means associated with said trigger means for waiting until a pin setter cycle is complete as determined by said rake returning to the raised position prior to actuating a further pinsetter cycle.

16. The improved pinsetter control of claim 15 further comprising a reset selector electrically connected to said trigger control, said trigger control further including reset means for automatically initiating a pinsetter cycle in response to actuation of said reset selector.

17. The improved pinsetter of claim 16 wherein said trigger control further comprises means associated with said trigger means for waiting a select time duration after the reset selector is actuated during a pinsetter cycle to actuate a further pin setter cycle.

18. The improved pin setter control of claim 10 wherein the trigger means automatically energizes the cycle solenoid after removal of a ball from blocking the light beam as determined by the receiver again receiving the light beam.

19. The improved pinsetter control of claim 10 further comprising means for developing a signal representing ball speed based on length of time the light beam is blocked.

20. In an automatic pinsetter including a pin setting deck structure movable toward and away from a pin supporting surface on a bowling lane for controlling setting of bowling pins on the lane supporting surface, a rake for sweeping pins from the lane, a rake up switch for sensing if the rake is in a raised position, a drive system operatively coupled to the deck structure and the rake and including a cycle solenoid, the drive system for controlling an automatic pin setter cycle in response to energization of the solenoid, the pin setter cycle controlling movement of the deck structure and the rake to selectively remove or set pins on the lane, and a pit cushion positioned at a rear end of the lane and linked to the rake to lower the rake from the raised position when a thrown ball strikes the pit cushion, an improved pinsetter control comprising:

a rake down switch for sensing if the rake is in a lower sweep position;

a pin setter trigger control electrically connected to said rake up switch, said rake down switch and said cycle solenoid, said trigger control including trigger means for automatically initiating a pin setter cycle after the rake up switch senses that the rake is not in the raised position and safety means for energizing the cycle solenoid only if the rake is in either the raised position or the sweep position after the pinsetter cycle is initiated.

21. The improved pinsetter control of claim 20 further comprising a reset selector electrically connected to said trigger control, said trigger control further including reset means for automatically initiating the pin setter cycle in response to actuation of said reset selector.

22. The improved pinsetter control of claim 20 further comprising a ball sensor mounted proximate the lane before the pit cushion for sensing presence of a ball on the lane and developing an electrical trigger signal in response thereto said trigger control further including electric trigger means for automatically initiating the pinsetter cycle in response to sensing presence of a ball on the lane.

23. The improved pinsetter control of claim 20 wherein said safety means also includes means for disabling said drive system if the rake is not in either the raised position or the sweep position.

24. In an automatic pinsetter including a pin setting deck structure movable toward and away from a pin supporting surface on a bowling lane for controlling setting of bowling pins on the lane supporting surface, a rake for sweeping pins from the 4 lane, a rake up switch for sensing if the rake is in a raised position, a drive system operatively coupled to the deck structure and the rake and including a cycle solenoid, the drive system for controlling an automatic pin setter cycle in response to energization of the solenoid, the pinsetter cycle controlling movement of the deck structure and the rake to selectively remove or set pins on the lane, and a pit cushion positioned at a rear end of the lane and linked to the rake to lower the rake from the raised position when a thrown ball strikes the pit cushion, an improved pinsetter control comprising:

a ball sensor mounted proximate the lane before the pit cushion for sensing presence of a ball on the lane and developing an electrical trigger signal in response thereto;

a ball selector means for selecting if a thrown ball is a first or second ball thrown in a bowling frame; and a pinsetter trigger control electrically connected to said rake up switch, said ball sensor, said ball selector means and said cycle solenoid, said trigger control including trigger means for automatically energizing said cycle solenoid to initiate a pinsetter cycle after either the rake up switch senses that the rake is not in the raised position or the ball sensor has sensed presence of a ball on the lane and time delay means for delaying operation of the trigger means if the ball is the first ball thrown.

25. In an automatic pinsetter including a pin setting deck structure movable toward and away from a pin supporting surface on a bowling lane for controlling setting of pins on the lane supporting surface, a rake for sweeping pins from the lane and movable between a raised position away from the deck and a lowered position proximate the deck, the rake sweeping pins in the lowered position, a drive system operatively coupled to the deck structure and the rake for controlling an automatic pinsetter cycle by controlling movement of the deck structure and the rake to selectively remove or set pins on the lane, and means operatively associated with the drive system for initiating the pinsetter cycle, a safety shutoff system comprising:

first sensing means for sensing if the rake is in the raised position;

second sensing means for sensing if the rake is in the lowered position;

a pin setter safety control operatively associated with the drive system and connected to said first and said second sensing means and including means for disabling said drive system if the rake is not in either the raised position or the lowered position during the automatic pinsetter cycle.

26. The safety shutoff system of claim 25 wherein said pinsetter safety control further comprises means for preventing operation of said initiating means if the rake is not in either the raised position or the lowered position.

27. The automatic pinsetter of claim 25 wherein said initiating means comprises a reset button for energizing a cycle solenoid, the cycle solenoid energization initiating the pinsetter cycle, and wherein the pinsetter safety control disables said drive system if the rake is not in either the raised position or the lowered position during the automatic pinsetter cycle initiated by the reset button.

* * * * *